United States Patent [19]

Davis

[11] 4,347,405

[45] Aug. 31, 1982

[54] SOUND REPRODUCING SYSTEMS UTILIZING ACOUSTIC PROCESSING UNIT

[75] Inventor: Lanny C. Davis, Buffalo Grove, Ill.

[73] Assignee: CBS Inc., New York, N.Y.

[21] Appl. No.: 176,617

[22] Filed: Aug. 15, 1980

Related U.S. Application Data

[63] Continuation-in-part of Ser. No. 72,965, Sep. 6, 1979, abandoned.

[51] Int. Cl.[3] ..... H04S 1/00

[52] U.S. Cl. ..... 179/1 G; 179/1 E; 84/DIG. 1; 84/DIG. 27

[58] Field of Search ..... 179/1 G, 1 GA, 1 J, 179/1 E, 156 R; 84/1.01, DIG. 1, DIG. 27

[56] References Cited

U.S. PATENT DOCUMENTS

| | | | |
|---|---|---|---|
| 3,789,164 | 1/1974 | Ryder | 179/156 R |
| 4,087,629 | 5/1978 | Atoji et al. | 179/1 G |
| 4,110,583 | 8/1978 | Lepper | 179/156 R |
| 4,134,323 | 1/1979 | Markowitz | 179/1 G |

FOREIGN PATENT DOCUMENTS

| | | | |
|---|---|---|---|
| 53-12301 | 2/1978 | Japan | 179/1 G |

*Primary Examiner*—Douglas W. Olms
*Attorney, Agent, or Firm*—Spencer E. Olson

[57] ABSTRACT

A system for reproducing a plurality of electro-acoustic signals each corresponding, for example, to a channel signal of a multichannel electronic keyboard instrument, includes an acoustic processing unit which comprises a plurality of electro-acoustic transducers, one for each signal, so arranged within a substantially sealed enclosure as to convert the electro-acoustic signals to corresponding acoustic signals and to mix them to produce a pair of composite sound signals each containing at least one dominant component corresponding to an applied electro-acoustic signal and sub-dominant components related to other applied electro-acoustic signals. In one embodiment, a pair of acoustic transmission paths are provided for coupling the composite sound signals to the left and right ears, respectively, of a listener. The sound image felt by the listener is localized externally of the head of the listener and simulates what the listener would experience if the multiple channels were separately acoustically reproduced in a listening room. In another embodiment the two composite sound signals are converted into corresponding electro-acoustic signals which may be applied to respective power amplifiers and loudspeakers, or to the left and right earpieces of an electro-acoustic headset, for acoustic reproduction.

27 Claims, 4 Drawing Figures

SOUND REPRODUCING SYSTEMS UTILIZING ACOUSTIC PROCESSING UNIT

BACKGROUND OF THE INVENTION

This application is a continuation-in-part of application Ser. No. 72,965 filed Sept. 6, 1979, now abandoned.

This invention relates generally to sound reproducing systems, and more particularly to an acoustic processing system which converts a plurality of electro-acoustic signals to a pair of composite sound signals which may be acoustically transmitted to the right and left ears of the listener, or, alternatively, converted to electro-acoustic signals for reproduction by a pair of electro-acoustic transducers.

Generally, when an electro-acoustic signal from a radio receiver or the like is reproduced by a loudspeaker, sound radiated from the loudspeaker is transmitted directly to the left and right ears of the listener as direct sound and at the same time it is transmitted to the ears of the listener as indirect sound produced by reflection from the walls and floors of a listening room. When such composite sound reaches the ears of the listener, he feels a sound image externally of his head because of the contribution to acoustical distance perception by the indirect sound. However, when the electro-acoustic signal from the radio receiver is reproduced by an earphone, the sound image is localized internally of the head of the listener because no indirect sound is included.

Similarly, when a listener is properly placed with respect to the loudspeakers in a stereo sound reproducing system, sound radiated from both speakers is transmitted to both the left and right ears as direct sound and at the same time sound from both loudspeakers is transmitted to the ears of the listener as indirect sound produced by reflection. However, when the stereophonic signals are reproduced by stereophonic headphones, not only is the indirect sound eliminated, but the left ear hears only the left channel information and the right ear hears only the right channel signal, substantially diminishing the sensation of depth and direction. Actually, the diminution in stereo effect may not always be serious, especially in the case of recorded music, because during recording the microphone (or microphones) utilized to form the left channel would pick up to varying degrees all of the soundwaves in the room, both direct sounds and indirect sounds produced by reflections, and the microphone (or microphones) for the right channel likewise, and by reason of the displacement of the microphones, upon reproduction the ears will detect a depth of field when a stereo headset is used. The microphone array used in originally recording the sound signals has, in essence, pre-processed the signals to allow the listener to hear in a binural reproducing system all of the sounds "heard" by the microphones.

The situation is quite different in an electronic organ, for example, the simplest form of which has at least two channels and a separate loudspeaker for reproducing the electroacoustic signals in each channel. As in the case of stereophonic reproduction, when the organ is played in an open room the left ear hears sound radiated from both speakers (which may be designated left and right) and the left ear likewise hears sound radiated from both the left and right loudspeakers and, additionally, indirect sound produced by reflections from the walls and floors of the listening room are heard by both ears. However, when the electro-acoustic signals are reproduced by a set of headphones, the left ear hears only the sounds that would otherwise be produced by the left loudspeaker and the right ear would hear only the sounds normally produced by the right loudspeaker, which means that, regardless of the fidelity, the listener would not hear the same program that is heard when listening to the loudspeakers. It is one thing to attempt to reproduce the full fidelity of full size loudspeakers in a set of headphones, but it is quite another to emulate the aural interaction of the two-speaker system when it is open into the listening room and the ears can hear both loudspeakers and the indirect sound produced by reflections. There being no recording involved, the signal processing techniques employed in stereophonic recording are not available to preserve any of the depth or other effects of acoustical and aural interaction.

Headphone reproduction of a musical program produced by the more expensive electronic organs, which typically have four to six or more channels and a separate loudspeaker for each, bears little resemblance to the program heard when the loudspeakers radiate sound into a room. With the intention that the organ is to be played into an open room, the electro-acoustic signals selected for reproduction by the individual channels, the relative spacing of the loudspeakers, and the adjustment of component values, are designed to cause it to sound the way the designer wants it to sound to a person listening to it with both ears in an open listening room. For example, there is usually a separate channel for bass pedal notes, and four other channels may carry string sounds and other ensemble effects more realistically to emulate such effects by reason of emanating from four different spatial locations. The problem with attempting to use headphones for reproducing the program produced by such an organ is that the left ear will hear only the channels the designer prescribes for the "left" channel and the right ear will hear only those channels assigned to the "right" channel. This not only involves electrical mixing of signals from two or more channels, which introduces the risk of cancellation and/or undesirable adding of signal components, but introduces the question of which organ channel signals should be combined to form the "left" and "right" signals for the headphones. The decision is subjective at best, and, in any case, what is heard by the listener bears little resemblance to what would be heard in an open room where the sounds from the several channels are mixed acoustically in the volume between the surfaces of the loudspeakers and the ears of the listener.

Apart from the aspect of unsatisfactory earphone reproduction of the electro-acoustic signals from a multichannel musical instrument, in the case of a multichannel electronic organ having three, four, or possibly six or seven acoustic channels, the cost of the reproducing channels is rather high in that each usually has a power capability of about 35 watts and a separate relatively expensive loudspeaker. Equally if not more important is the space required to accommodate the loudspeakers which are usually and desirably built into the console, particularly in the case of organs intended for use in the home. The problem becomes especially acute as organs are designed to have more and more channels—eight to ten would be desirable for a three-manual organ—without an appreciable increase in the size of the console, the dimensions of which are essentially fixed by the length of the keyboard and the intended placement in the home, when it is further considered that the loudspeakers must be judiciously arranged to distribute the sound from all these channels and to prevent undesired cross-coupling between channels, back waves, etc.

A primary object of the present invention is to reduce the cost and space requirements of the acoustic reproducing channels of an electronic keyboard musical instrument.

Another object of the invention is to provide an acoustic processing system for enabling binaural reproduction of a plurality of electroacoustic signals by an acoustic headphone wherein the sound transmitted to the ears of the listener closely simulates the sound image that would be heard in an open room.

Still another object of the present invention is to provide an acoustic processing system for enabling realistic reproduction of a plurality of electro-acoustic signals by an electro-acoustic headphone wherein the sound signals reproduced at the ears of the listener closely simulate the sound image that would be heard if the plural electro-acoustic signals were transduced into an open room.

SUMMARY OF THE INVENTION

Briefly, these objects are achieved by providing an acoustic processing unit in which electro-acoustic signals from a multichannel signal source are converted to corresponding acoustic signals which are acoustically mixed to produce two, or a multiple of two, composite sound signals each containing a dominant component corresponding to a different applied electro-acoustic signal and sub-dominant sounds related to the other applied electro-acoustic signals. The acoustic processing unit consists of a substantially sealed box-like enclosure, in which a plurality of electro-acoustic transducers, one for each signal, each of which may be a small loudspeaker, are mounted to provide the necessary acoustic interaction between the sound waves radiated by the respective loudspeakers to produce the described composite sound signals at a pair of acoustic output ports. More particularly, the loudspeakers are arranged within the enclosure such that pressure variations within the closed air volume due to the vibrations of the diaphragm of each energized speaker mechanically induce sound-producing vibrations in the diaphragms of the others such that each radiates a composite sound wave containing a dominant sound wave corresponding to its applied electro-acoustic signal and sub-dominant sound waves corresponding to the mechanically-induced vibrations of its diaphragm. In essence, the enclosure may be thought of as a miniature room in which a plurality of electro-acoustic signals are acoustically reproduced and acoustically mixed.

For the binaural reproduction of the plurality of electro-acoustic signals in an acoustic headphone, a pair of acoustic transmission paths each including a sound-transmitting earpiece are coupled to the enclosure of the acoustic processing unit for coupling the said two composite sound signals, or two selected combinations of two or more each of said composite sound signals, to the right and left ears, respectively of the listener.

Alternatively, the pair of composite sound signals produced at the acoustic output ports are converted to a pair of corresponding composite electro-acoustic signals for reproduction by a pair of electro-acoustic transducers, such as an electrical headphone or a pair of loudspeakers. In the latter case, by using the described acoustic mixing and reduction of the multichannel signals to two composite sound signals means that multiple amplifier channels are still required, but each channel is much less costly and much smaller in size in that very small inexpensive speakers requiring no more than a few milliwatts of power per channel are used in the acoustic processing unit, which can be supplied by inexpensive integrated circuit amplifiers. Only the two reproducing channels utilized to acoustically reproduce the pair of composite electro-acoustic signals require high power amplifiers and large, relatively expensive loudspeakers.

BRIEF DESCRIPTION OF THE DRAWINGS

Other objects, features and advantages of the invention will become apparent, and its construction and operation better understood, from the following detailed description of preferred embodiments, when read in conjunction with the accompanying drawings, in which.

DESCRIPTION OF PREFERRED EMBODIMENTS

Figure 1:
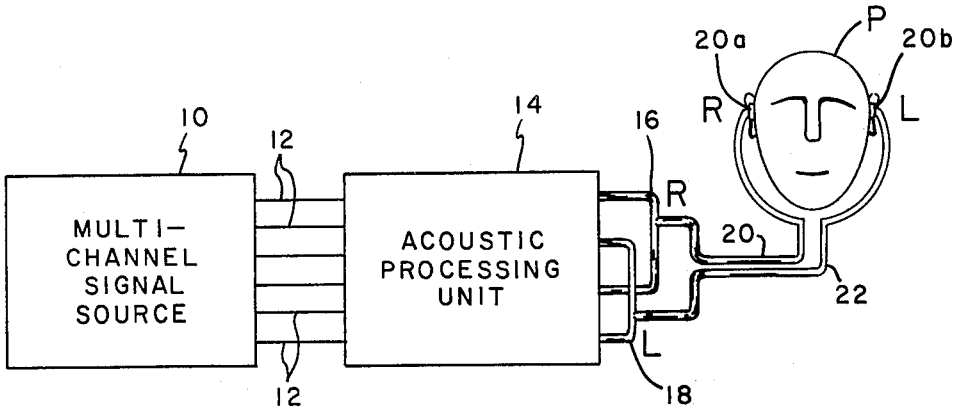
FIG. 1 is a schematic diagram of the present invention.

Referring now to the drawings, FIG. 1 illustrates the acoustic headphone embodiment of the invention in schematic form as consisting of a multi-channel signal source 10, such as a multi-channel electronic organ, which produces six separate electro-acoustic signals on six separate output lines 12. In the case of an electronic organ, the output signals would be derived from the output system of the respective channels, immediately ahead of the loudspeaker for the channel. The six electro-acoustic signals from source 10 are applied to an acoustic processing unit 14, wich comprises a substantially sealed enclosure in which a corresponding number of electro-acoustic transducers are mounted and connected to receive a respective electro-acoustic signal. Sound signals radiated from the individual transducers are acoustically mixed within the enclosure to produce composite sound signals which are acoustically coupled from the enclosure by acoustic transmission means 16 and 18 and are transmitted through a pair of acoustic paths 20 and 22 having earpieces **20*a* and 20*b*, respectively, to the right ear R and the left ear L of a listener P. Each of acoustic transmission means 16 and 18 includes a pair of acoustic pipes arranged to couple sound from two different spaced-apart portions of the enclosure volume, which are joined together and to the transmission paths 20 and 22, respectively, by a "T"-connection, so as to produce in the transmission paths 20 and 22** separate sound waves each containing a dominant sound wave corresponding to one or more selected different ones of the electro-acoustic signals applied to the processing unit and sub-dominant sounds corresponding to others of the applied electro-acoustic signals. Accordingly, the listener P hears in both ears some portion of the sound radiated from all of the transducers, some more predominantly than others.

Figure 2:
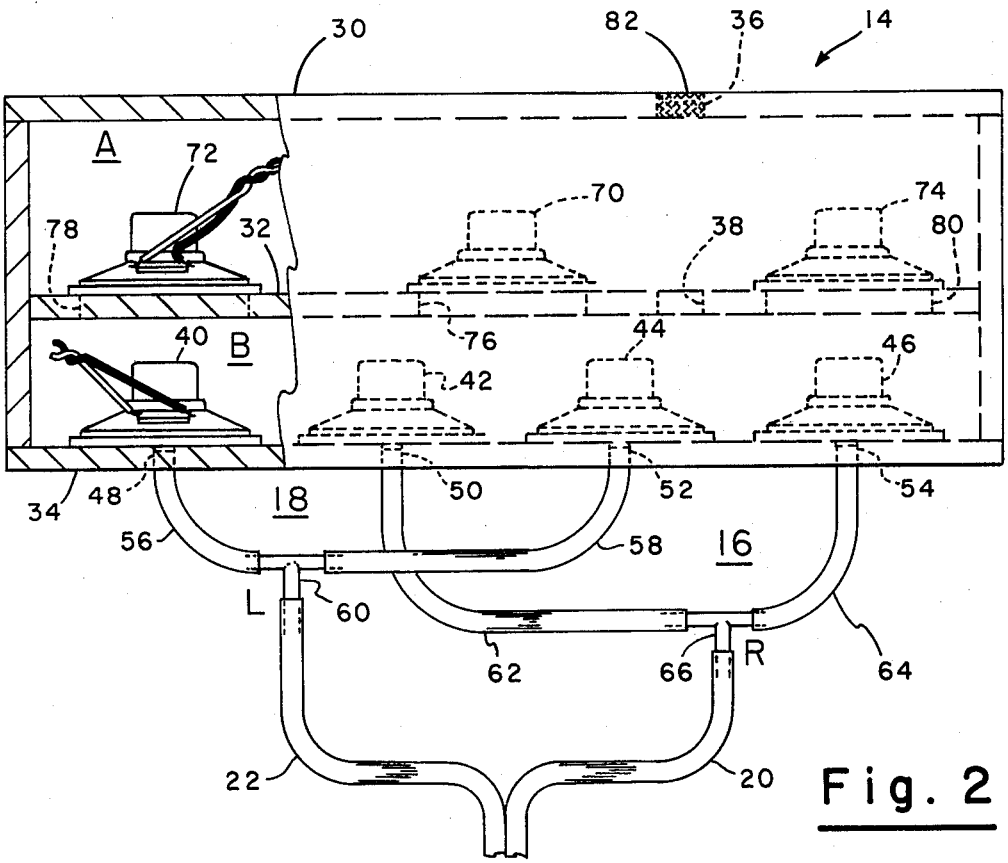
FIG. 2 is an elevation view partly cut away, of an acoustic processing unit according to the invention.
Figure 3:
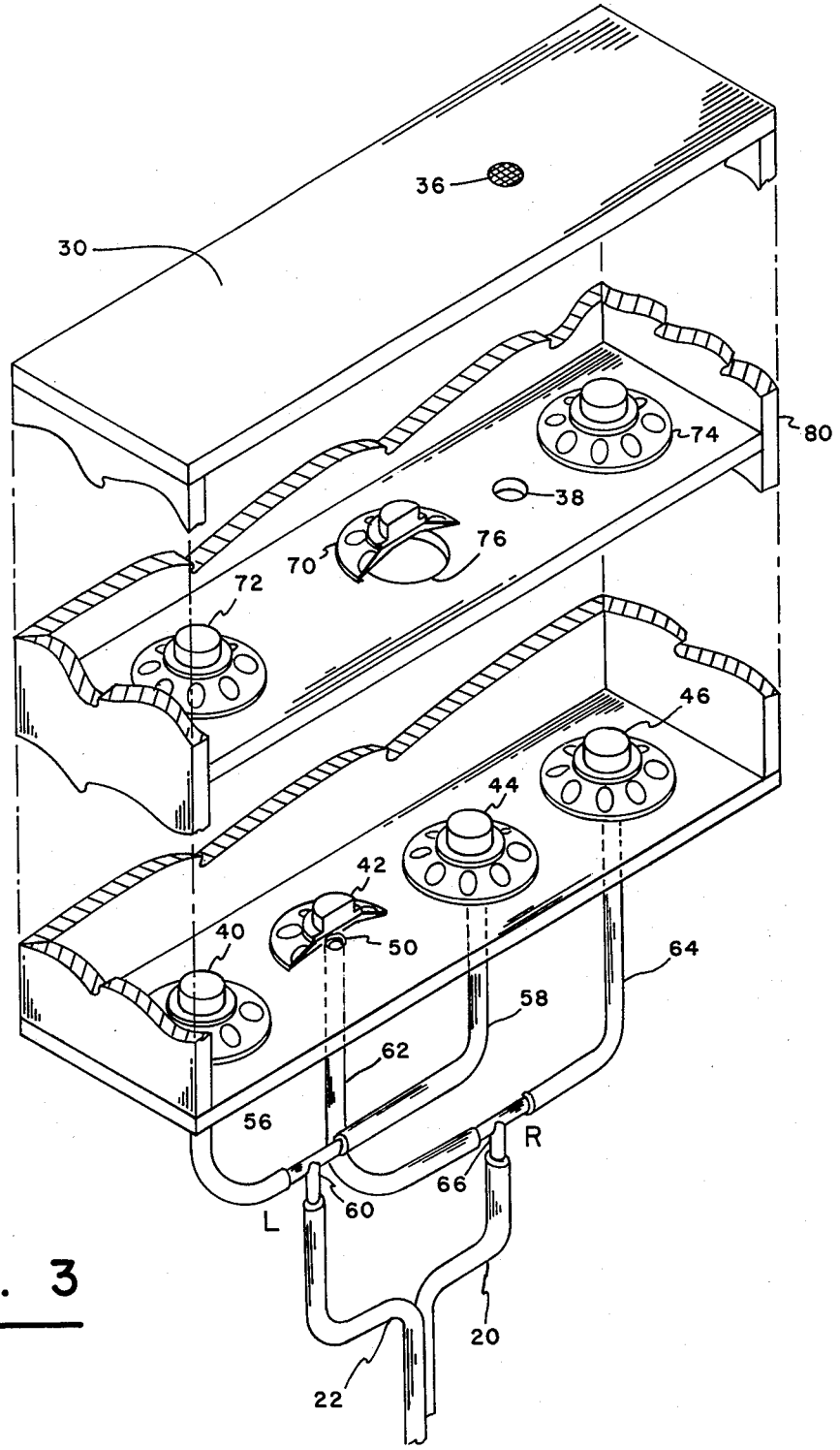
FIG. 3 is an exploded perspective view, partly cut away, of the acoustic processing unit of FIG. 2.

As illustrated in FIGS. 2 and 3, which are elevation and perspective views, respectively, a preferred construction of acoustic processing unit 14 comprises a relatively small box-like enclosure 30 which may be formed of wood or a rigid plastics material; in a successfully operated embodiment the enclosure, made of wood, was approximately ten inches long, about four inches high and about three inches deep. The internal volume of the enclosure is divided into two approximately equal volume chambers A and B by a baffle 32 disposed parallel to the front wall 34 of the enclosure. The enclosure is sealed except for a single port 36 for porting chamber A, and chamber A is ported to chamber B by an opening 38 formed in baffle 32. The function of the ports will be evident as the description proceeds.

In the embodiment illustrated in FIGS. 2 and 3, seven conventional loudspeakers, each having a circular vibratile diaphragm approximately two inches in diameter, are mounted within the enclosure. Four of the loudspeakers 40, 42, 44 and 46 are supported on the inner surface of wall 34 and uniformly distributed along the length dimension thereof, and, as shown in FIG. 3, substantially equidistant from the side walls of the enclosure. Each of the loudspeakers has the usual driver and basket disposed behind the speaker cone. Loudspeakers 40, 42, 44 and 46 are mounted with the outer perimeter of their diaphragms in direct contact with the inner surface of wall 34, so as to trap a relatively small volume of air between the diaphragm and the wall, and are positioned concentrically with respect to relatively small circular openings 48, 50, 52 and 54 in wall 34, typically having a diameter of ¼ inch. Each of these four loudspeakers is connected to receive an electro-acoustic signal from a different one of the channels of the electronic organ which, for example, may be those channels which respectively predominantly carry electro-acoustic signals representing diapason sounds, tibia sounds, string sounds, and string ensemble sounds; that is, the sounds prominently involved in the creation of animation in an electronic organ. When channel is connected to which of the four loudspeakers is a matter of choice of the designer, dependent on which two of the four channels are to be dominant in the two sound signals transmitted to the earphones, as will now be explained.

The openings 48 and 52 respectively confronting the diaphragms of loudspeakers 40 and 44 are acoustically coupled together by acoustic transmission paths 56 and 58 and to acoustic transmission path 22 by a "T"-junction 60, each of which transmission paths may be a length of quarter-inch flexible plastic tubing. Similarly, the openings 50 and 54 respectively confronting the speaker cones of loudspeakers 42 and 46 are coupled together by transmission paths 62 and 64 and through a "T"-junction 66 to tube 20, the transmission path going to the right earphone. The part of "T"-junctions 60 and 66 joined to tubes 22 and 20 constitute, in essence, a pair of acoustic output ports for the processing unit at which respective ones of a pair of composite sound signals are produced. Each of loudspeakers 40, 42, 44 and 46 and its associated acoustic transmission path functions similarly to a conventional stethescope; the cone of the loudspeaker is analogous to the diaphragm chest piece of a stethescope instrument and the tubing is not unlike the ear tubes of the stethescope. Sound waves generated by variations in the pressure of the air confined between the speaker diaphragm and the inner surface of wall 34 caused by vibrations of the diaphragm are transmitted by the sound conducting tube and earplugs to the ear of the user. The acoustic transmission paths 56, 58, 62 and 64 preferably are of equal length so as to introduce substantially the same transmission losses and thus provide a balance in the acoustic power supplied to sound conducting tubes 20 and 22. The efficiency of the transmission of sound from the enclosure is inversely proportional to the volume of air trapped between the speaker cone and the inner surface of wall 34; therefore, best results are obtained when loudspeakers having relatively shallow diaphragms are used.

The rationale of the described acoustic transmission means for coupling sound energy from chamber B of the enclosure will be understood if it be assumed that an electro-acoustic signal is applied to only loudspeaker 40. Vibration of the cone of the speaker 40 in response to energization of the driver thereof causes corresponding variations in the pressure of the air enclosed between the speaker cone and the wall 34, and these pressure variations are transmitted through tube 56, utilizing the principle of a stethescope, to "T"-junction 60 and to the left earphone. At the same time, the back side of the vibrating diaphragm of loudspeaker 40 causes variations in the pressure of the air enclosed in chamber B, which pressure changes are imposed on the back surface of the diaphragms of loudspeakers 42, 44 and 46, the effect decreasing with increasing distance from loudspeaker 40. The resulting pressure-induced vibrations of the diaphragms of speakers 42, 44 and 46 cause corresponding variations in pressure of the volume of air defined by the front surface of the cone and wall 34, thereby causing sound waves generally corresponding to the electro-acoustic signal applied to speaker 40 to emanate from openings 50, 52 and 54 as well. The mechanically-induced sound produced by loudspeaker 42, which is of greater amplitude than that produced by loudspeakers 44 and 46 by reason of its closer proximity to the electrically energized loudspeaker 40, is coupled via tube 62 and "T"-junction 66 to transmission path 20 and the right earphone, and opening 54 confronting loudspeaker 46 is also coupled to the right earphone. The sound signal parasitically produced by loudspeaker 44 in response to energization of speaker 40 is coupled via tube 58 to "T"-junction 60 and transmission path 22 to the left earphone. Thus, the sound signal generated by electrically-energized loudspeaker 40 is dominant in the left earphone, and a reduced amplitude proportion of a substantially corresponding sound signal appears at the right earphone, thereby to simulate to a significant degree what each ear would hear when a single tone is acoustically reproduced in a listening room environment.

It will now be evident that if any two of the four loudspeakers is simultaneously electrically energized, one of them will produce a dominant sound signal in one of the earphones and the other will produce a dominant sound signal in the other earphone, and the listener will also hear in both ears sub-dominant sound signals from each of the other three loudspeakers. This result obtains whether the two electrically energized speakers are adjacent or non-adjacent. It follows that if all four of loudspeakers 40, 42, 44 and 46 are energized simultaneously, a listener will hear in his right ear dominant sounds corresponding to the electro-acoustic signals applied to loudspeakers 42 and 46 and in his left ear will hear dominant sounds corresponding to the signals energizing loudspeakers 40 and 44, and in both ears will hear sub-dominant sounds corresponding to the electro-acoustic signals applied to the other loudspeakers.

The composition of the composite sound waves appearing at the left and right earphones is further affected by sound waves radiated directly into chamber B by additional loudspeakers, in the illustrated embodiment, three, supported within chamber A on baffle 38. A loudspeaker 70 connected to receive the electro-acoustic signals from the bass channel of the organ is preferably positioned equidistant from the ends of the baffle so as to straddle speakers 42 and 44, and two additional speakers 72 and 74 are positioned in alignment with speakers 40 and 46, respectively. The loudspeakers 70, 72 and 74 are concentrically placed over respective openings 76, 79 and 80 in baffle 32 having diameters substantially equal to the diameter of the speaker cones so as to radiate, when energized, sound waves directly into chamber B. Thus, the sound waves radiated by one or more of loudspeakers 70, 72 and 74 mechanically induce a corresponding signal onto the back sides of the diaphragms of loudspeakers 40, 42, 44 and 46 to a degree determined by the proximity of an energized speaker to the speakers from which sound is acoustically coupled to the headphones. Each of loudspeakers 70, 72 and 74, when energized, will also mechanically induce a corresponding lower amplitude signal onto the backside of the diaphragm of the other two loudspeakers to further affect the sound signals emanating from the front side of the diaphragm into chamber B. Because low frequency tones are essentially omni-directional in a listening room environment, the speaker 70 selected to reproduce the electro-acoustic signal from the bass channel is positioned as centrally as possible with respect to the other loudspeakers so as to have a substantially equal effect thereon and thus appear in substantially equal amplitude in both earphones of the headset to simulate the real live room environment, in which it is difficult to tell where the bass tones are coming from. Speakers 72 and 74 can be used for any other desired effect; for example, piano-like tones might be reproduced through loudspeaker 72, and loudspeaker 74 might be energized by an electro-acoustic signal having characteristics to simulate the effect of a Leslie rotating speaker.

The port 36 in wall 30 allows maximum deflection of the low frequency speaker 70, and thus greater efficiency than if chamber A were sealed, and port 38 in the baffle allows porting of the sound in chamber B in the event that very low frequency sound signals should be produced therein. The basis function of earphones being to listen to the program one is playing without disturbing others, the port 36 is preferably stuffed with acoustic damping material 82 to minimize the escape of high frequency notes through port 36; the port is sufficiently small in diameter as to preclude any bass tones being heard. The damping material may be fiberglass acoustic insulation or other suitable acoustic damping material known to the art.

Although the described embodiment has four loudspeakers with alternate ones grouped in pairs to produce the dominant sound signals for the left and right earphones, it is to be understood that the principle can be extended to enclose a larger even number of loudspeakers in chamber B, and acoustically mixing the sound output from alternate ones of the speakers into the left earphone channel and acoustically mixing the outputs from the others and transmitting the composite sound signal to the right earphone channel. For example, should it be desired to reproduce as dominant signals the electro-acoustic signals from six separate channels, three acoustic paths would be utilized to mix and couple the signals from three of the loudspeakers to the left transmission path 22, and the signals from the other three loudspeakers would be similarly mixed and coupled to the right acoustic transmission path 20. If necessary or desired, the number of loudspeakers mounted on baffle 32 may be correspondingly increased. Thus, the inventive principle may be utilized to acoustically process as few as two electro-acoustic signals, or as many as there are likely to be in an electronic organ, even the most sophisticated. Should the processing unit be designed for exclusive use in the processing of stereophonic electro-acoustic signals, all that is required is an enclosure defining a single chamber in which only two transducers are supported, and a pair of acoustic transmission paths respectively coupled to the two transducers for coupling the two acoustic signals to the left and right ears of the listener. Each of the transducers will mechanically induce its vibrations in the other transducer, providing additional acoustic processing generally equivalent to that which would be provided if the stereophonic signals were reproduced by a pair of loudspeakers radiating into a listening room.

Also, although the disclosed embodiment of the acoustic processing unit employs but two chambers, the invention contemplates the provision of one or more additional chambers "stacked" above chamber A, each containing one or more loudspeakers supported to radiate sound energy into the adjacent chamber. For example, a third chamber, with wall 30 serving as a baffle, may be provided above chamber A, and one or more loudspeakers supported over openings therein substantially equal in diameter to the diameter of the speakers, so as to radiate sound energy into chamber A when energized by a respective electro-acoustic signal. The sound energy radiated into chamber A will mechanically induce corresponding vibrations in the diaphragms of the loudspeakers supported in chamber A which, in turn, will mechanically induce vibrations in the diaphragms of the loudspeakers supported in chamber B to be acoustically coupled from the unit to the earpieces of the acoustic transmission paths. It may be desirable in certain applications, for example, to place in the third chamber a bass speaker, of large diameter than the speakers employed in the other chambers, for supplying essentially omni-directional bass tones to both the left and right earpieces.

Although acoustic transmission means 16 and 18 have been described as comprising flexible plastic tubing of a particular diameter, it is contemplated that other sized tubing may be used and that the acoustic transmission paths may take other forms, as, for example, passageways of appropriate size molded or otherwise formed in the wall 34 and communicating with a pair of nipple connectors projecting from the wall to which the earphone transmission paths 20 and 22 can be connected. Further, although tests have shown that the smaller the loudspeakers (and consequently the smaller the enclosure) the better the described acoustic processing unit works, acceptable performance is possible with loudspeakers larger than those used in the described embodiment. Thus, it is preferred to utilize the smallest commercially available loudspeakers (which usually have relatively shallow diaphragms to thus enhance the stethescope effect) to gain the further advantages of reduction of the cost and weight of the acoustic processing unit and ease and convenience of mounting it in the organ cabinet.

As an alternative to the described acoustic reproduction of the composite sound signals produced at the acoustic output ports of the acoustic processing unit, they may be converted to respective corresponding electrical signals for reproduction by electro-acoustic transducers, such as electric headphones or a pair of loudspeakers. To this end, the composite sound signals produced at the output ports of the processing unit, that is, at the outputs of "T"-junctions 60 and 66, are applied to respective acoustic-electric transducers, shown in FIG. 2A as a pair of loudspeakers 90 and 92 supported within respective cavities C and D defined by a box-like enclosure 94 having a baffle 96 which divides the internal volume of the enclosure into two substantially equal volume cavities. The enclosure may be formed of wood or a rigid plastics material, and each of cavities C and D is ported to the ambient by openings 98 and 100, respectively, formed in a wall of the enclosure. Loudspeakers 90 and 92, each of which has the usual driver and basket disposed behind the speaker cone, are mounted with the outer perimeter of their diaphragms in direct contact with the inner surface of wall 102 of the enclosure, concentrically with respect to circular openings in wall 102 in which short sections of hollow tubing 22 and 20 are inserted for coupling the composite sound signals from the acoustic output ports of the processing unit of FIG. 2 into the volumes defined by the wall 102 and the cones of speakers 90 and 92, respectively. Vibration of the speaker cones in response to the respective applied composite sound signals produce respective corresponding electrical signals having the same information content as the applied acoustic signals. The enclosure 94 is comparable in size to the enclosure of the acoustic processing unit, and if, as suggested earlier, the acoustic transmission paths take the form of passageways molded or otherwise formed in the wall 34 of the processing unit and communicating with a pair of nipple connectors, the upper wall 102 of enclosure 94 may be mounted immediately adjacent wall 34 of the acoustic processing unit enclosure for compactness and to shorten the acoustic transmission paths from the acoustic output ports to the acoustic-electric transducers. Loudspeakers 90 and 92 may be of the same size and type as those utilized in the processing unit and typically are inexpensive, readily available, one-inch or two-inch diameter speakers of the type employed in transistor radios.

Although the acoustic-electric transducers have been described as comprising loudspeakers, it is contemplated that alternatively microphones may be used to convert the composite sound signals to corresponding electrical signals.

Figure 2A:
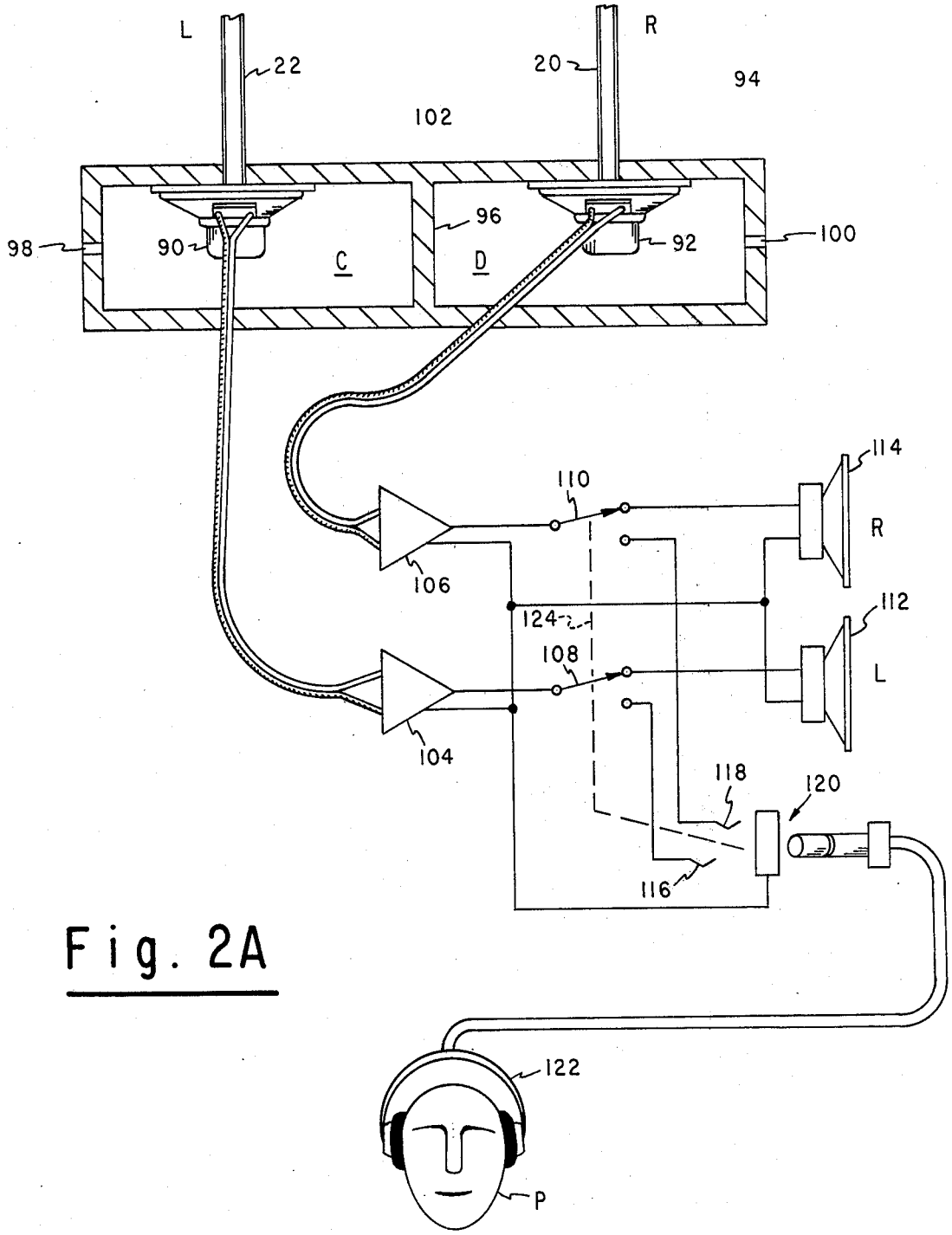
FIG. 2A is a fragmentary elevation view of a transducer useful for converting sound signals produced by the acoustic processing unit of FIG. 2 to electrical signals in combination with electro-acoustic reproduction systems.

The electric-acoustic signals from transducers 90 and 92 may be reproduced by any desired electro-acoustic transducers, the alternatives of loudspeaker reproduction and electric earphone reproduction being illustrated in FIG. 2A. The signals from transducers 90 and 92, representative of "left" (L) and "right" (R) composite sound signals, respectively, are applied to respective power amplifiers 104 and 106, and the amplified signals are alternatively applied, by actuation of a pair of ganged switches 108 and 110, to a pair of loudspeakers 112 and 114, or to the contacts 116 and 118 of the jack 120 of stereophonic electric headphones 122. As indicated by dotted line 124, the outputs of amplifiers 104 and 106 are normally applied to loudspeakers 112 and 114, and when the earphone jack is inserted the switches are activated to disconnect the loudspeakers and to apply the amplified signal to the headphones. Although not shown in FIG. 2A, it will be understood that because of the relatively high power capability of ampilfiers 104 and 106 required to drive the loudspeakers, it may be necessary to attenuate the amplified signals before application to the headphone.

It will now be evident that the use of the acoustic processing unit of FIG. 2 for acoustically processing and mixing signals from a plurality of independent channels, seven in the disclosed embodiment, to produce two composite sound signals, converting the two composite sound signals to corresponding electro-acoustic signals, and reproducing the two electrical signals with respective loudspeakers, greatly reduces the cost and space requirements of the sound reproduction system. Whereas a conventional organ system with the same number of channels requires seven reproduction channels each including a 30-watt amplifier and a relatively large and expensive loudspeaker, each of the order of six to ten inches in diameter, the present invention enables comparable reproduction of a like number of channels with nine small, inexpensive loudspeakers, seven low power amplifiers, one for each of the loudspeakers contained in the acoustic processing unit, each of which requires a power capability of no more than a few hundred milliwatts, only two high power amplifiers, of the order 30 to 35 watts each, and only two large loudspeakers, of the order of ten inches to twelve inches in diameter, for presentation of the multichannel signals to the outside world. Quite apart from the cost savings, the resulting saving in space enables the design and manufacture of organs with a large number of channels, desirably as many as eight or ten, which can be accommodated in a console of limited volume dictated by the length of the keyboard and tradition. Heretofore it has been totally unfeasible to accommodate more than about six conventional reproduction channels in a console of the size desired for intended home use. Moreover, when the electrical signals corresponding to the composite sound signals are reproduced by stereophonic electric headphones, the left ear hears the "left" channel and the right ear hears the "right" channel as determined by the characteristics of the acoustic processing unit; in other words, the headphone listener hears essentially the same presentation as would be heard from the pair of loudspeakers 112 and 114, and there is no cancellation or undesirable adding of signal components.

Although the invention has been described with reference to specific embodiments, variations within the spirit and scope of the invention will occur to those skilled in the art. For example, the acoustic processing unit may take physical forms other than those specifically described or suggested, and the acoustic-electric transducers may take forms other than the example shown and described.

I claim:

1. A system for reproducing at least first and second electro-acoustic signals each corresponding to a different channel of a multi-channel electronic musical instrument comprising, in combination:

an acoustic processing unit, said acoustic processing unit comprising:

a substantially sealed enclosure having at least first and second openings in a wall thereof, acoustic transmission means defining first and second acoustic output ports acoustically coupled to said first and second openings, respectively, at least first and second electro-acoustic transducers mounted on said wall over said at least first and second openings, respectively, each connected to receive an electro-acoustic signal from a respective one of said channels for converting said electro-acoustic signals to corresponding acoustic signals and supplying acoustic power only to a respective output port and so arranged relative to each other that an electrically energized transducer mechanically induces substantially corresponding vibrations in the other transducers; and sound reproducing means coupled to the acoustic output ports of said acoustic processing unit for reproducing the sound signals supplied thereto.

2. System according to claim 1, wherein said sound reproducing means comprises a pair of acoustic transmission paths coupled to respective acoustic output ports of said acoustic processing unit for transmitting said respective sound signals directly toward the left and right ears of a listener as direct sounds.

3. System according to claim 2, wherein said acoustic transmission paths are hollow tubes of the same diameter each connected at one end to a respective acoustic output port.

4. System according to claim 3, wherein said tubes are of substantially the same length.

5. System according to claim 1, wherein said sound reproducing means comprises a pair of acoustic-electric transducers coupled to respective acoustic output ports of said acoustic processing unit for converting said respective sound signals to respective corresponding electrical signals, and a pair of electro-acoustic transducers for converting said respective electrical signals to respective corresponding sound signals.

6. System according to claim 5, wherein said electro-acoustic transducers are electric headphones.

7. System according to claim 5, wherein said electro-acoustic transducers are loudspeakers.

8. System according to claim 7, wherein said sound reproducing means further includes a power amplifier for each said loudspeaker, and wherein said power amplifiers and the loudspeakers of said sound reproducing means have a much higher power capability than the electro-acoustic transducers contained in said enclosure.

9. System according to claim 1, wherein the enclosure of said acoustic processing unit is a walled enclosure having at least first and second spaced-apart openings through one wall thereof to which said acoustic output ports are respectively coupled, and wherein each of said electro-acoustic transducers is a loudspeaker having a vibratile diaphragm, and wherein at least a first and a second of said loudspeakers are supported on said one wall each with its diaphragm over a respective opening.

10. System according to claim 9, wherein said enclosure has an even number of spaced-apart openings through said one wall, wherein a like even number of loudspeakers are supported on said one wall each with its diaphragm covering a respective one of said openings, and wherein said acoustic transmission means comprises a first group of acoustic transmission paths for coupling sound waves from half of said openings to a first acoustic output port, and a second group of acoustic transmission paths for coupling sound waves from the other half of said openings to the other acoustic output port.

11. System according to claim 10, wherein said one wall has length and width dimensions and said openings are substantially uniformly spaced along the length dimension, and wherein the acoustic transmission paths of said first group are coupled to alternate odd ones of said openings, and the acoustic transmission paths of said second group are coupled to alternate even ones of said openings.

12. System according to claim 1, wherein said enclosure has an internal baffle disposed substantially parallel to and spaced from said one wall dividing the volume defined by said enclosure into a first chamber enclosing said at least first and second electro-acoustic transducers and a second chamber, and wherein said acoustic processing unit further comprises:

at least one additional electro-acoustic transducer mounted on said baffle within said second chamber each connected to receive an electro-acoustic signal from another different one of said channels and each operative, when energized, to radiate sound waves into said first chamber for mechanically inducing substantially corresponding vibrations in the transducers supported in said first chamber.

13. System according to claim 12, wherein said at least one additional electro-acoustic transducer is a loudspeaker having a vibratile diaphragm, and is supported in an opening in said baffle substantially equidistant from the ends thereof with its diaphragm facing said first chamber, and connected to receive electroacoustic signals from the bass channel of said electronic musical instrument.

14. System according to claim 13, wherein a plurality of electro-acoustic transducers are supported in respective spaced-apart openings in said baffle and each connected to receive an electro-acoustic signal from a different one of said channels and each operative, when energized, to radiate sound waves into said first chamber.

15. System according to claim 12, wherein said baffle has an opening therethrough for providing a port between said first and second chambers.

16. System according to claim 13, wherein said second chamber is ported to the ambient for improving the efficiency of said at least one additional loudspeaker.

17. An acoustic processing unit for producing first and second composite acoustic signals from at least first and second electro-acoustic signals, said processing unit comprising:

a box-like substantially sealed enclosure having at least first and second openings in a wall thereof, acoustic transmission means defining first and second separate acoustic output ports acoustically coupled to said first and second openings, at least first and second electro-acoustic transducers mounted within said enclosure over said at least first and second openings, respectively, for converting said electro-acoustic signals to corresponding acoustic signals and supplying acoustic power only to respective ones of said acoustic output ports and so arranged relative to each other that an energized transducer mechanically induces substantially corresponding vibrations in the other transducers, and means for supplying first and second different electrical signals to said at least first and second transducers, respectively.

18. Acoustic processing unit according to claim 17, wherein said enclosure is a rectangular box having said openings in one wall thereof, and wherein each of said transducers is a loudspeaker having a vibratile diaphragm supported on said one wall with its diaphragm confronting a respective opening.

19. Acoustic processing unit according to claim 18, wherein said enclosure has an even number greater than two of spaced-apart openings in said one wall, wherein a like even number of loudspeakers are supported on said wall each with its diaphragm confronting a different one of said openings and so arranged relative to each other that each energized loudspeaker mechanically induces substantially corresponding vibrations in the other loudspeakers, and wherein said acoustic transmission means comprises a first group of hollow tubes for acoustically coupling sound waves from half of said openings to a first of said acoustic output ports, and a second group of hollow tubes for acoustically coupling sound waves from the other half of said openings to the second of said acoustic output ports.

20. Acoustic processing unit for producing first and second composite acoustic signals from a plurality of electro-acoustic signals, said processing unit comprising:

a substantially sealed enclosure having at least first and second openings in a wall thereof, acoustic transmission means defining a pair of separate acoustic output ports acoustically coupled to said first and second openings, at least first and second electro-acoustic tranducers mounted within said enclosure over said at least first and second openings, respectively, for converting applied electro-acoustic signals to corresponding acoustic signals and supplying acoustic power only to respective ones of said acoustic output ports and so arranged relative to each other that an energized transducer mechanically induces substantially corresponding vibrations in the other transducers, an internal baffle dividing the volume defined by said enclosure into a first chamber enclosing said at least first and second transducers and a second chamber, at least one additional electro-acoustic transducer mounted on said baffle within said second chamber each connected to receive a different electrical signal and each operative, when energized, to radiate sound waves into said first chamber for mechanically inducing substantially corresponding vibrations in the transducers mounted in said first chamber, and means for supplying first, second and third different electro-acoustic signals to said at least first, second and one additional transducers, respectively.

21. A system for reproducing at least first, second and third electro-acoustic signals each corresponding to a respective channel, comprising:

a substantially sealed enclosure having at least first and second spaced-apart openings in a wall thereof;

at least first, second and third electro-acoustic transducers mounted within said enclosure each connected to receive a different one of said electro-acoustic signals for converting said electro-acoustic signals to respective corresponding acoustic signals, said first and second transducers being supported on said wall over said at least first and second openings, respectively, for supplying acoustic power only to respective ones of said openings and so arranged relative to each that an energized transducer mechanically induces substantially corresponding vibrations in the other of said first and second transducers, and said third transducer is so positioned relative to said first and second transducers that when energized it radiates sound waves for mechanically inducing substantially corresponding vibrations in said first and second transducers, means for coupling from said at least first and second openings the acoustic signals radiated by said first and second transducers for deriving first and second composite sound signals each containing different proportions of said acoustic signals, and sound reproducing means for reproducing said first and second composite sound signals.

22. System according to claim 21, wherein said sound reproducing means comprises first and second acoustic transmission paths for respectively transmitting said first and second composite sound signals directly to the left and right ears of a listener as direct sounds.

23. System according to claim 21, wherein said sound reproducing means comprises first and second acoustic-electric transducers for respectively converting said first and second composite sound signals to respective corresponding electrical signals, and first and second electro-acoustic transducers for respectively converting said respective electrical signals to respective corresponding sound signals.

24. System according to claim 23, wherein said electro-acoustic transducers are stereophonic electric headphones.

25. System according to claim 23, wherein said electro-acoustic transducers are loudspeakers.

26. Acoustic processing unit according to claim 20, wherein said enclosure is a rectangular box having an even number greater than two of spaced-apart openings in said wall, wherein a like even number of electro-acoustic transducers are mounted on said wall each over a respective opening, and wherein said acoustic transmission means comprises a first group of hollow tubes for acoustically coupling sound waves from half of said openings to a first of said acoustic output ports, and a second group of hollow tubes for acoustically coupling sound waves from the other half of said openings to the second of said acoustic output ports.

27. Acoustic processing unit according to claim 20 or 26, wherein each transducer mounted within said first chamber is a loudspeaker having a vibratible diaphragm supported on said one wall with its diaphragm confronting a respective opening; and wherein each transducer mounted within said second chamber is a loudspeaker having a vibratible diaphragm supported in an opening in said baffle with its diaphragm facing said first chamber.

* * * * *